US009237617B1

(12) United States Patent
Xiong

(10) Patent No.: US 9,237,617 B1
(45) Date of Patent: Jan. 12, 2016

(54) LED DRIVER WITH INHERENT CURRENT LIMITING AND SOFT STARTUP CAPABILITY

(71) Applicant: Universal Lighting Technologies, Inc., Madison, AL (US)

(72) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/681,628

(22) Filed: Apr. 8, 2015

Related U.S. Application Data

(60) Provisional application No. 61/991,976, filed on May 12, 2014.

(51) Int. Cl.
*H05B 37/00* (2006.01)
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0815; H05B 33/0833
USPC ..... 315/207, 291, 297
See application file for complete search history.

(56) References Cited

U.S. PATENT DOCUMENTS

2009/0184668 A1* 7/2009 Mednik ..... H05B 33/0815 315/297
2014/0028214 A1* 1/2014 Mazumdar ..... H05B 33/0815 315/279
2015/0048678 A1* 2/2015 Gong ..... H05B 33/0851 307/24

* cited by examiner

*Primary Examiner* — Don Le
(74) *Attorney, Agent, or Firm* — Patterson Intellectual Property Law, P.C.; Mark J. Patterson; Gary L. Montle

(57) ABSTRACT

An inductor-less LED driver circuit is provided with soft startup and inherent current limiting capabilities. A diode rectifier is coupled across an AC mains input, with the outputs for the rectifier coupled directly across an LED array. A bi-directional switching circuit and current limiting capacitor are coupled in series between a first mains input and a first rectifier input. A controller turns the bi-directional switching circuit on and off to enable or disable conduction of power from the AC power source, wherein the bi-directional switching circuit is turned on in association with a detected zero voltage state for AC input power, and the bi-directional switching circuit is turned off in association with a detected zero current state for AC input power. The controller further adjusts switch states for the bi-directional switching circuit in response to a dimming control signal corresponding to a desired lighting output level.

20 Claims, 3 Drawing Sheets

LED DRIVER WITH INHERENT CURRENT LIMITING AND SOFT STARTUP CAPABILITY

CROSS-REFERENCES TO RELATED APPLICATIONS

This application claims benefit of U.S. Provisional Patent Application No. 61/991,976, dated May 12, 2014, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to circuitry and methods for providing current to a light source such as an LED load. More particularly, the present invention relates to dimmable LED drivers with soft startup capability.

Light emitting diode ("LED") lighting is growing in popularity due to decreasing costs and long life compared to incandescent lighting and fluorescent lighting. LED lighting can also be dimmed without impairing the useful life of the LED light source.

Typically, an LED driver is a switching power supply, implementing a DC-DC converter to regulate the LED current. The associated costs for such LED drivers are relatively high, and therefore it is desirable to minimize the cost as much as possible.

For this reason, LED drivers have been designed which may be driven directly from the AC input line power supply. Such an LED driver does provide certain advantages as implied above, in that it does not use DC-DC power converter technology and may be constructed at extremely low cost. However, additional problems arise from their use. For example, most AC mains-driven LED drivers have complicated current control requirements, and cannot effectively solve turn-on "inrush" current problems. Inrush currents are relatively high spikes in current which are typically produced at least once with each cycle of the AC mains line voltage. If an LED driver does not provide appropriate inrush current protection, such spikes may dramatically affect the LED life and/or produce undesirable flickering.

BRIEF SUMMARY OF THE INVENTION

A low-cost, dimmable and inductor-less LED driver as disclosed herein is provided with soft startup and inherent current limiting capabilities.

In one embodiment, a lighting device as disclosed herein is provided with an input having first and second terminals connectable to an AC power source. A controllable switch module is coupled to the first AC power source input terminal, and is configured to conduct power in association with a detected zero voltage state for power received from the AC power source, and further to disable conduction in association with a detected zero current state. A current limiting capacitor is coupled to the output for the controllable switch module and thereby defines a maximum peak output current for the device. A rectifier circuit has a first input coupled to the capacitor and a second input coupled to the second AC power source input terminal, and first and second outputs, wherein AC input power is rectified into DC output power across the first and second rectifier outputs.

In a particular exemplary aspect of certain lighting devices according to the present invention, the first and second rectifier outputs define device output terminals which are configured to directly receive first and second ends of an LED array.

In another exemplary aspect of certain lighting devices according to the present invention, the rectifier circuit may be formed by a full bridge diode rectifier.

In another exemplary aspect of certain lighting devices according to the present invention, the controllable switch module is configured to respond to a dimming control signal corresponding to a desired lighting output level to adjust a conduction period for the switch module.

In another exemplary aspect of certain lighting devices according to the present invention, the controllable switch module includes a controller and a bi-directional switching circuit. The controller is configured to provide control signals for turning the bi-directional switching circuit on and off to enable or disable conduction of power from the AC power source. As one example, the bi-directional switching circuit may include first and second unidirectional switching elements coupled in anti-parallel. As another example, the bi-directional switching circuit may include first and second switching elements coupled in series via their respective source electrodes. The first and second switching elements are further coupled in parallel with respective first and second diodes having inverse polarities. As still another example, the bi-directional switching circuit may include first and second switching elements coupled in series via their respective drain electrodes. The first and second switching elements are further coupled in parallel with respective first and second diodes having inverse polarities. As yet another example, the bi-directional switching circuit may include a first branch and a second branch coupled in parallel, with the branches each including a switching element and a diode having respective inverse polarities.

In another exemplary aspect of certain lighting devices according to the present invention, a current sensor may be coupled between the controllable switch module and the capacitor, and arranged to feed a current through the current sensor back to the controller.

In another exemplary aspect of certain lighting devices according to the present invention, first and second resistors may be coupled in series between the first and second AC power source input terminals so as to define a voltage sensor, wherein a node between the first and second resistors is coupled to feed back to the controller.

In another exemplary aspect of certain lighting devices according to the present invention, a resistance is coupled on a first end to a node between the controllable switch module and the capacitor, and on a second end to the first AC power source input terminal. The capacitor is configured upon disabling of power conduction from the controllable switch module to discharge power through the resistance and the rectifier outputs.

In yet another exemplary aspect of certain lighting devices of the present invention, the capacitor is further configured upon disabling of power conduction from the controllable switch module to discharge power to a zero volt level prior to a subsequent zero volt state for power received from the AC power source.

In yet another exemplary aspect of certain lighting devices of the present invention, the input power from the AC power source is converted to the DC output power from the rectifier circuit without an inductive element.

DETAILED DESCRIPTION OF THE INVENTION

Figure 1:
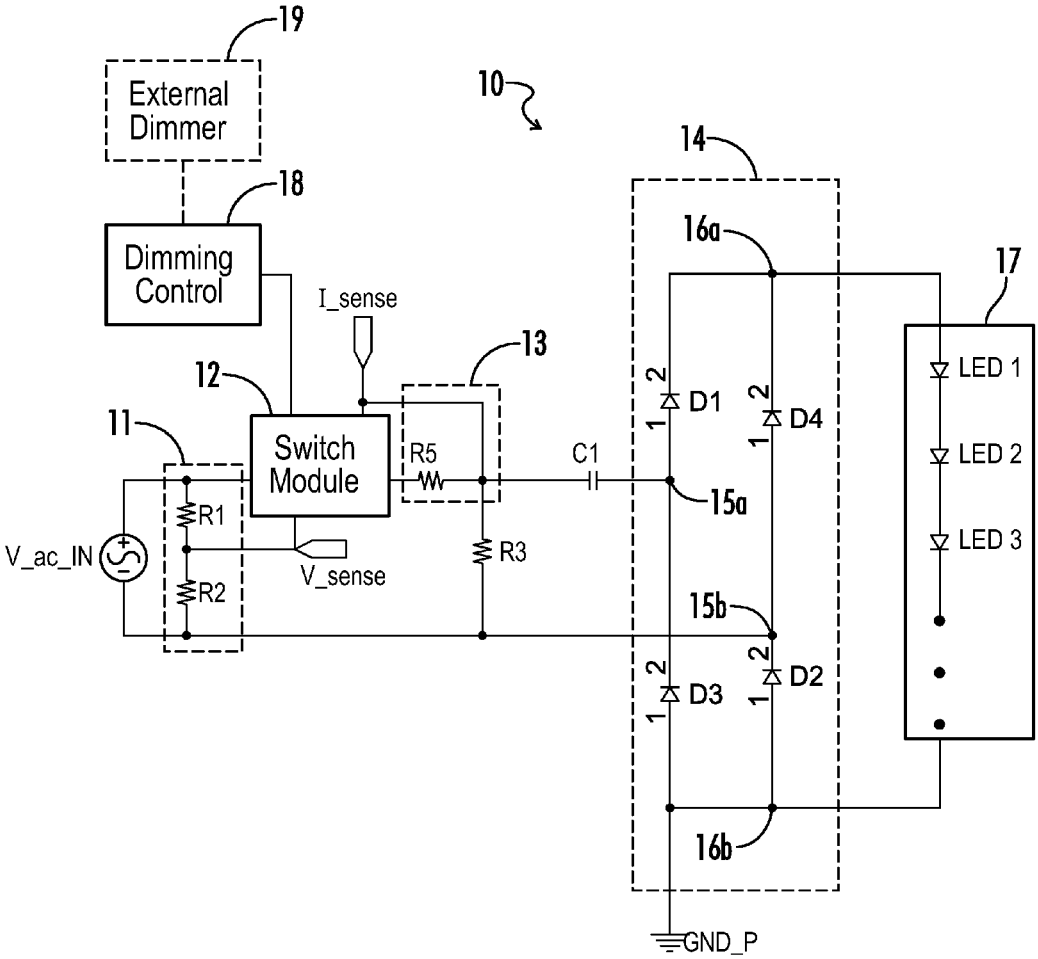
FIG. 1 is a block diagram and partial circuit schematic representing an exemplary LED driver according to an embodiment of the present invention.
Figure 2:
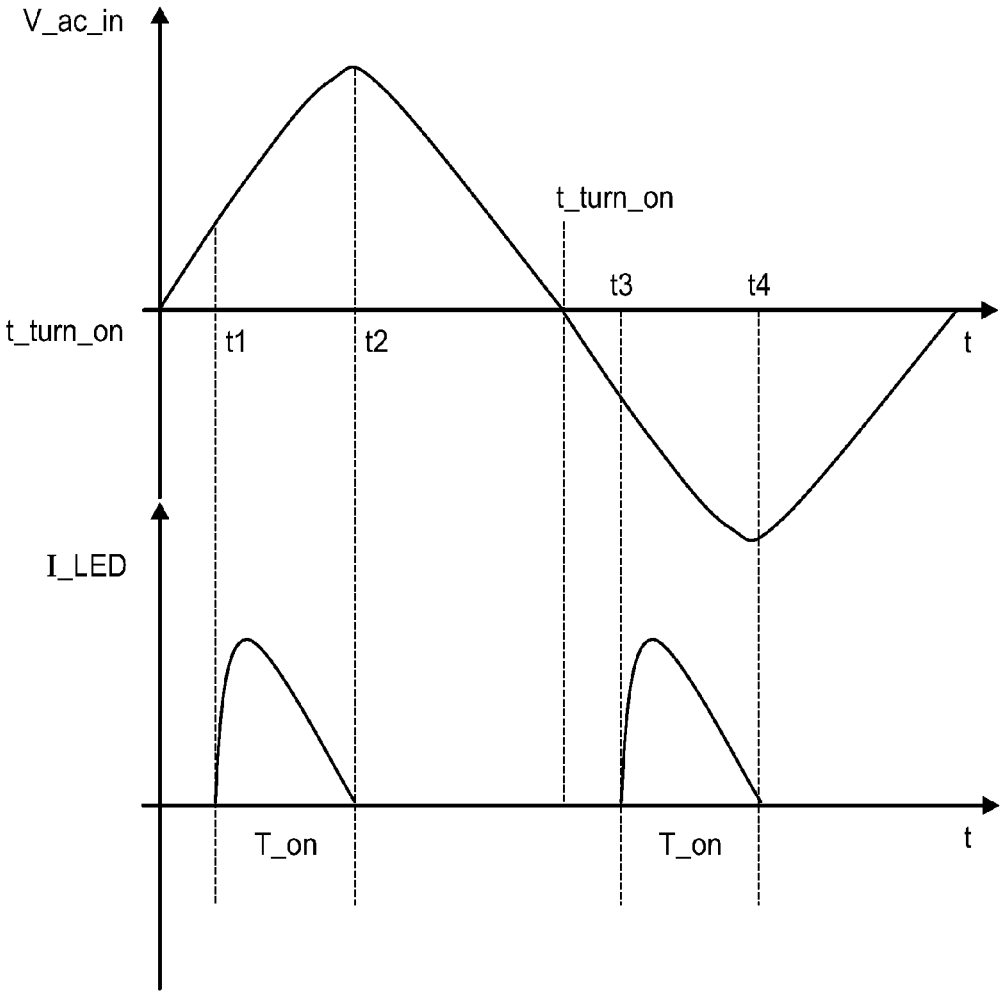
FIG. 2 is a graphical diagram representing a first example of LED current and on-time control operation according to the LED driver of FIG. 1.
Figure 3:
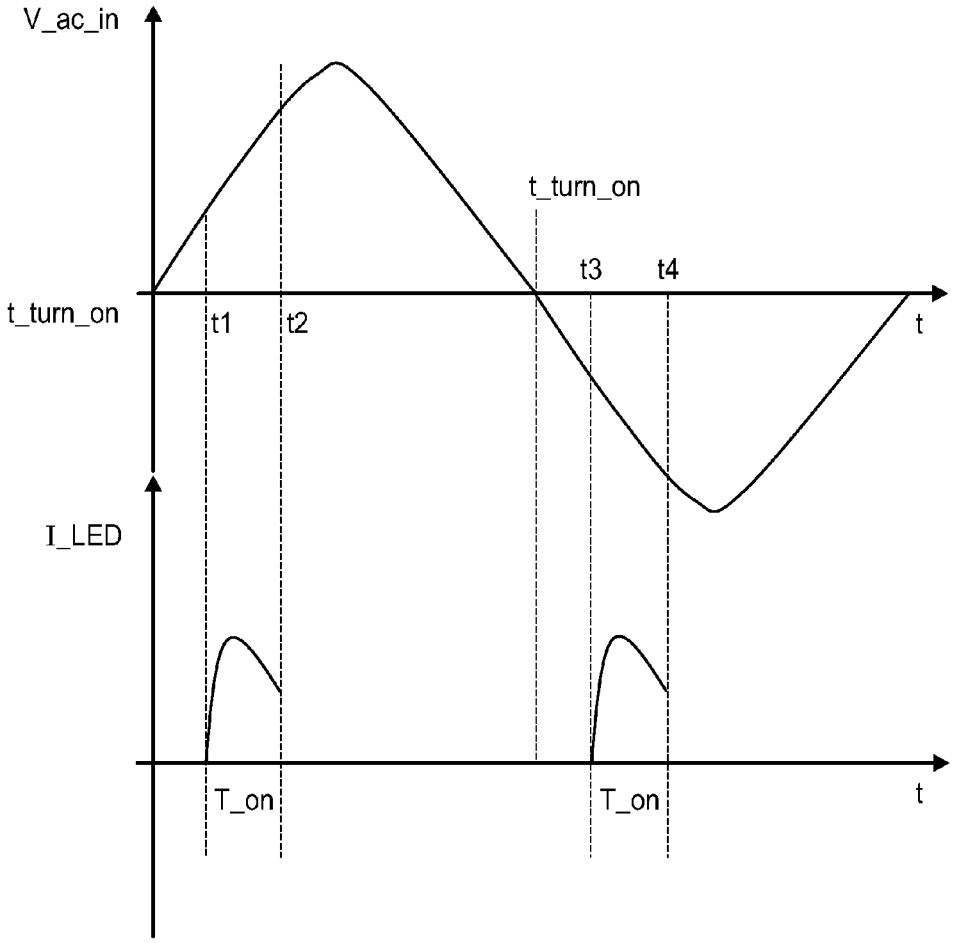
FIG. 3 is a graphical diagram representing a second example of LED current and on-time control operation according to the LED driver of FIG. 1.

Referring generally to FIGS. 1-3, various exemplary embodiments of the invention may now be described in detail. Where the various figures may describe embodiments sharing various common elements and features with other embodiments, similar elements and features are given the same reference numerals and redundant description thereof may be omitted below.

As represented in FIG. 1, an exemplary LED driver 10 includes an input end which may be connected to an input AC voltage source V_ac_IN. A voltage sensor 11 is coupled across the input terminals and may be formed by a voltage divider including resistors R1 and R2. In the example shown, a node between the resistors R1, R2, is coupled to feed back the sensed voltage (V_sense) to a controllable switch module 12. A current sensing resistor R5 is coupled to an output end of the switch module 12, with an output from the resistor being coupled back to the switch module 12 for current sensing feedback (I_sense). A current limiting capacitor C1 is coupled in series with the switch module 12 and the current sensor R5. A resistance R3 may be coupled across the input terminals to define a discharge path for the capacitor C1.

An input rectifier circuit 14 as shown may include diodes D1, D2, D3 and D4 in a full bridge configuration, having a first rectifier input 15*a* coupled to the current limiting capacitor C1 and a second rectifier input 15*b*. The output of the input diode rectifier bridge may be configured with output terminals 16*a* and 16*b* for direct connection to a lighting source such as for an example a string, array or equivalent configuration of LEDs 17. The lower output terminal 16*b* may be coupled to circuit ground.

The controllable switch module 12 may in an embodiment include a controller and a bi-directional zero voltage turn-on and zero current turn-on switching circuit. The controller may generally be configured to provide control signals (directly or otherwise indirectly via one or more switch driving circuits) for turning the bi-directional switching circuit on and off to enable or disable conduction of power from the AC power source.

One of skill in the art may appreciate that a number of topologies for the bi-directional switching circuit may be provided to accomplish the features and operations of the present invention. As one example, the bi-directional switching circuit may include first and second unidirectional switching elements coupled in anti-parallel. The bi-directional switching circuit may include first and second switching elements coupled in series via their respective source electrodes, or alternatively via their respective drain electrodes, the first and second switching elements further coupled in parallel with respective first and second diodes having inverse polarities. The bi-directional switching circuit may alternatively include a first branch and a second branch coupled in parallel, with the branches each including a switching element and a diode having respective inverse polarities. In still further embodiments, the bi-directional switching circuit may include thyristors or the like.

In certain embodiments, the switch module 12 may be coupled to a dimming controller 18 which provides signals to the switch module representative of a desired dimming level or otherwise a desired lighting output for the LED lighting source. In certain embodiments, the dimming controller 18 may be further configured to receive dimming control signals from an external dimmer source 19.

Referring further to FIG. 2, an exemplary operation of an LED driver of the present invention may now be described beginning with some arbitrary time, with AC power being applied across the input terminals. The AC mains input (V_ac_in) in the example as shown is provided as a sine waveform centered about the zero axis (i.e., with no DC offset) and having a peak input value (V_ac_peak). The controller for the bi-directional switching circuit senses the zero crossing of the input voltage and turns on the switch at time "t_turn_on" (at or substantially about the zero voltage crossing moment). At time "t1" the input voltage from the AC source reaches a certain value that is equal to the turn-on threshold voltage of the output diode string. Accordingly, at time t1 the load starts to conduct current. At time "t2" the input voltage from the AC source reaches the peak value. Because of the current limiting capacitor C1, the LED load will stop conducting, as at the peak of the input voltage:

$$C_1 \cdot \frac{dV}{dt} = 0$$

Referencing the negative portion of the input voltage cycle, at zero input current (or "t3") the controller for the bi-directional switch circuit senses the zero current and turns off the switch. After t3, capacitor C1 will discharge through the output terminals, thereby through the LED load, and further through the discharge path defined by resistor R3, so that at the beginning of the negative cycle the voltage across the capacitor C1 will be zero, and thereby realizing a zero startup inrush current for the LED load.

In the next cycle of the input voltage, the bi-directional switch circuit will essentially repeat the same operations to control the LED current.

Generally stated, during operation of the LED driver as disclosed herein the maximum peak current of LED is limited by capacitor C1:

$$\frac{V_{ac_in_peak}}{2 \cdot \pi \cdot f_{line} \cdot C_1} = I_{LED_max}$$

As previously noted, Vac_in_peak is the input voltage peak value. $F_{line}$ is the line frequency.

Because the bi-directional switch circuit is turned on at zero voltage, the output LED string will have soft start capability at all times, without high current inrush that could otherwise damage the LEDs. The maximum peak current is further inherently limited by the capacitor C1 which has the effect of substantially preventing runaway operation and associated damage to the LEDs.

With reference next to FIG. 3, one of skill in the art may appreciate that dimming of the LED lighting output may be implemented in various embodiments by changing the turn off timing (or ON time T_on) of the bi-directional switching circuit.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

The terms "switching element" and "switch" may be used interchangeably and may refer herein to at least: a variety of transistors as known in the art (including but not limited to FET, BJT, IGBT, IGFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A lighting device comprising:

an input having first and second terminals connectable to an AC power source;

a controllable switch module coupled to the first AC power source input terminal, the controllable switch module configured to conduct power in association with a detected zero voltage state for power received from the AC power source, and to disable conduction in association with a detected zero current state;

a capacitor coupled to the output for the controllable switch module and defining a maximum peak output current for the device; and a rectifier circuit having a first input coupled to the capacitor and a second input coupled to the second AC power source input terminal, and first and second outputs, the rectifier circuit configured to rectify AC input power received thereby into DC output power across the first and second rectifier outputs.

2. The lighting device of claim 1, wherein the first and second rectifier outputs comprise device output terminals configured to receive first and second ends of an LED array.

3. The lighting device of claim 2, wherein the rectifier circuit comprises a full bridge diode rectifier, and wherein a first diode is coupled between the first rectifier input and the first rectifier output, a second diode is coupled between the second rectifier input and the first rectifier output, a third diode is coupled between the second rectifier output and the first rectifier input, a fourth diode is coupled between the second rectifier output and the second rectifier input, and a ground terminal is coupled to the second rectifier output.

4. The lighting device of claim 1, wherein the controllable switch module is configured in response to a dimming control signal corresponding to a desired lighting output level to adjust a conduction period for the switch module.

5. The lighting device of claim 4, wherein the controllable switch module comprises a controller and a bi-directional switching circuit, and the controller is configured to provide control signals for turning the bi-directional switching circuit on and off to enable or disable conduction of power from the AC power source.

6. The lighting device of claim 5, wherein the bi-directional switching circuit comprises first and second unidirectional switching elements coupled in antiparallel.

7. The lighting device of claim 5, wherein the bi-directional switching circuit comprises first and second switching elements coupled in series via their respective source electrodes, the first and second switching elements further coupled in parallel with respective first and second diodes having inverse polarities.

8. The lighting device of claim 5, wherein the bi-directional switching circuit comprises first and second switching elements coupled in series via their respective drain electrodes, the first and second switching elements further coupled in parallel with respective first and second diodes having inverse polarities.

9. The lighting device of claim 5, wherein the bi-directional switching circuit comprises a first branch and a second branch coupled in parallel, the branches each comprising a switching element and a diode having respective inverse polarities.

10. The lighting device of claim 5, further comprising a current sensor coupled between the controllable switch module and the capacitor, and arranged to feed a current through the current sensor back to the controller.

11. The lighting device of claim 5, further comprising first and second resistors coupled in series between the first and second AC power source input terminals and defining a voltage sensor, a wherein a node between the first and second resistors is coupled to the controller.

12. The lighting device of claim 1, further comprising a resistance coupled on a first end to a node between the controllable switch module and the capacitor, and on a second end to the first AC power source input terminal, wherein the capacitor is configured upon disabling of power conduction from the controllable switch module to discharge power through the resistance and the rectifier outputs.

13. The lighting device of claim 12, wherein the capacitor is further configured upon disabling of power conduction from the controllable switch module to discharge power to a zero volt level prior to a subsequent zero volt state for power received from the AC power source.

14. The lighting device of claim 1, wherein the input power from the AC power source is converted to the DC output power from the rectifier circuit without an inductive element.

15. A method of producing a lighting output from an inductor-less LED driver coupled to an AC mains input, the LED driver comprising a controllable switch module and a capacitor coupled in series between a first AC input terminal and an input rectifier, the method comprising:

sensing a zero voltage state for an input from the AC mains;

enabling power conduction by the switch module in association with the sensed zero voltage state;

sensing a zero current state for the input from the AC mains; and disabling power conduction by the switch module in association with the sensed zero current state.

16. The method of claim 15, further comprising:

rectifying AC power discharged from the capacitor into DC output power; and providing the DC output power to an LED lighting source coupled across outputs for the input rectifier, wherein a lighting output is generated.

17. The method of claim 16, further comprising:

determining a desired lighting output level; and disabling power conduction by the switch module after a period of time corresponding to the desired lighting output level and further in association with the sensed zero current state.

18. An LED driver circuit comprising:

an AC input having first and second terminals;

a rectifier circuit having first and second input terminals and first and second output terminals;

a bi-directional switching circuit and a current limiting capacitor coupled in series between the first AC input terminal and the first input terminal for the rectifier circuit; and a controller configured to provide control signals for turning the bi-directional switching circuit on and off to enable or disable conduction of power from the AC power source, wherein the bi-directional switching circuit is turned on in association with a detected zero voltage state for power received via the AC input, and wherein the bi-directional switching circuit is turned off in association with a detected zero current state for power received via the AC input.

19. The circuit of claim 18, wherein the controller is configured in response to a dimming control signal corresponding to a desired lighting output level to adjust a conduction period for the bi-directional switching circuit.

20. The circuit of claim 19, wherein the capacitor is configured upon disabling of power conduction from the bi-directional switching circuit to discharge power to a zero volt level prior to a subsequent zero volt state of the AC input.

* * * * *